US008677545B2

(12) United States Patent
Vitt et al.

(10) Patent No.: US 8,677,545 B2
(45) Date of Patent: Mar. 25, 2014

(54) TOOTHBRUSH

(75) Inventors: Martin Vitt, Frankfurt am Main (DE); Gerhard Schaefer, Frankfurt am Main (DE); Jens Stoerkel, Frankfurt am Main (DE); Daniel Rudersdorf, Waldbrunn (DE)

(73) Assignee: Braun GmbH, Kronberg (DE)

( * ) Notice: Subject to any disclaimer, the term of this patent is extended or adjusted under 35 U.S.C. 154(b) by 139 days.

(21) Appl. No.: 12/596,060

(22) PCT Filed: Apr. 16, 2008

(86) PCT No.: PCT/EP2008/003009

§ 371 (c)(1),
(2), (4) Date: Aug. 23, 2010

(87) PCT Pub. No.: WO2008/128684

PCT Pub. Date: Oct. 30, 2008

(65) Prior Publication Data

US 2011/0000041 A1 Jan. 6, 2011

(30) Foreign Application Priority Data

Apr. 20, 2007 (DE) ..... 10 2007 018 766

(51) Int. Cl.
*A46B 9/04* (2006.01)

(52) U.S. Cl.
USPC ..... 15/167.1; 15/207.2

(58) Field of Classification Search
USPC ..... 15/110, 167.1, 207.2
See application file for complete search history.

(56) References Cited

U.S. PATENT DOCUMENTS

| | | | | |
|---|---|---|---|---|
| 3,567,569 | A * | 3/1971 | Ono et al. | 428/399 |
| 4,373,541 | A | 2/1983 | Nishioka | |
| 5,195,546 | A * | 3/1993 | Cansler et al. | 132/317 |
| 5,678,275 | A | 10/1997 | Derfner | |
| 6,058,541 | A | 5/2000 | Masterman et al. | |
| 6,141,818 | A * | 11/2000 | Weihrauch | 15/167.1 |
| 2003/0033682 | A1 | 2/2003 | Davies et al. | |
| 2004/0177462 | A1 | 9/2004 | Brown et al. | |
| 2005/0060822 | A1 | 3/2005 | Chenvainu et al. | |
| 2005/0160546 | A1 | 7/2005 | Weihrauch | |

FOREIGN PATENT DOCUMENTS

WO WO 2007/000922 A1 1/2007

OTHER PUBLICATIONS

PCT International Search Report dated Aug. 22, 2008.
PCT International Search Report date of mailing Aug. 22, 2008 for PCT/EP2008/003009; 4 pages.

* cited by examiner

*Primary Examiner* — Randall Chin
(74) *Attorney, Agent, or Firm* — James E. Oehlenschlager; Vladimir Vitenberg

(57) ABSTRACT

The invention relates to a toothbrush having a cleaning element formed of a plastic injection molded component, comprising an attachment segment for attachment in the head region of the toothbrush and a cleaning segment for cleaning teeth, and having at least one indentation in the region of the cleaning segment, around which the cleaning segment has an increased bending flexibility.

9 Claims, 4 Drawing Sheets

A-A

TOOTHBRUSH

Figure 1:
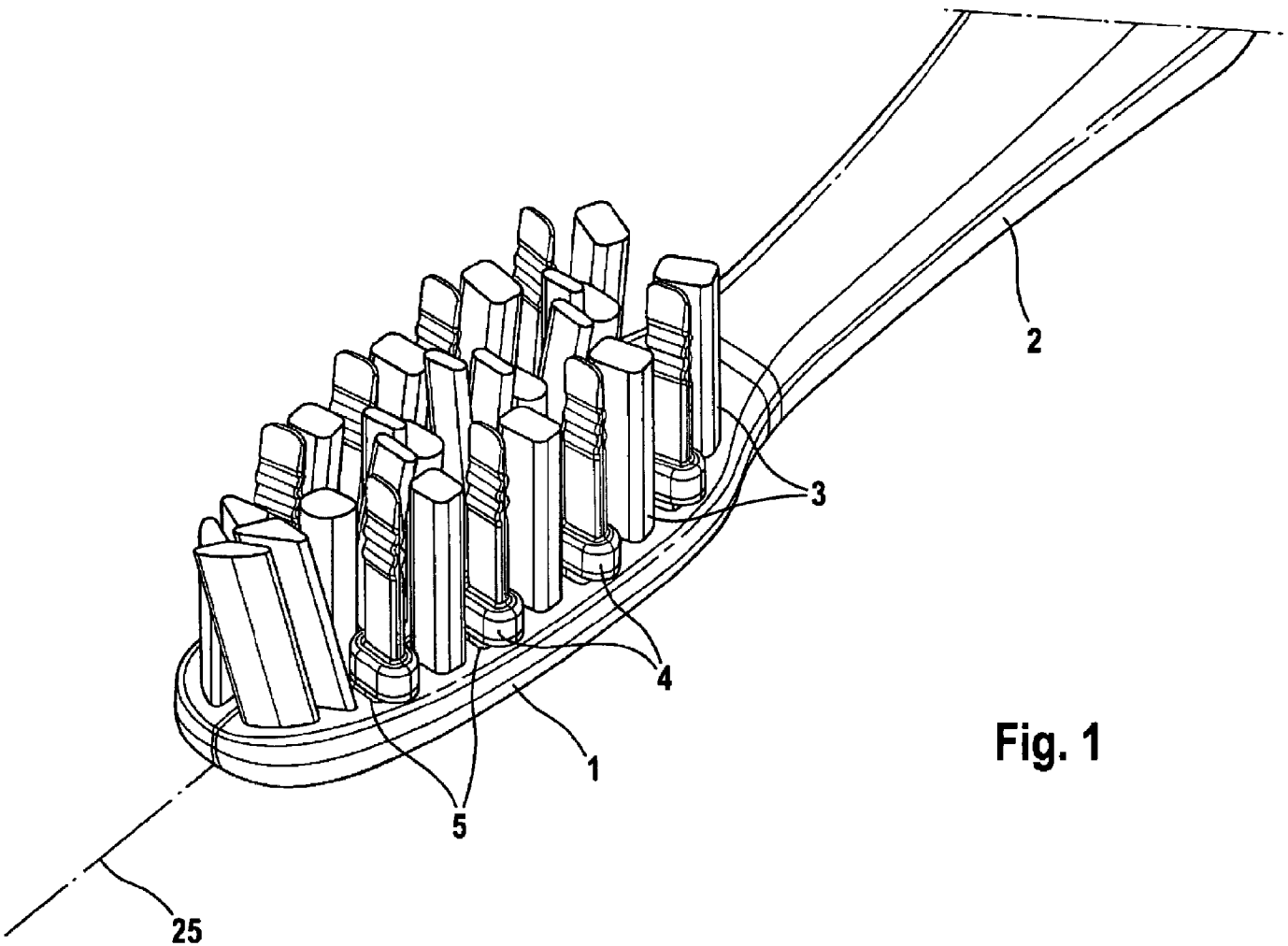

The present invention relates to a toothbrush having a cleaning element in the form of a plastic injection molded component, and that has an attachment segment for attaching in the head region of the toothbrush and a cleaning segment for cleaning the teeth.

A toothbrush of this type is known from WO 02/38004 A1. In this connection, the head region of the toothbrush has bristle bundles interspersed with cleaning elements which are in the form of a plastic injection molded component. The cleaning elements are preferably made from a thermoplastic elastomer and have a uniform cross sectional area in the longitudinal direction with regard to the cleaning segment.

A toothbrush having cleaning elements formed from a plastic injection molded component is also known from WO 03/055351 A1. In general, forming cleaning elements from a plastic injection molded component instead of from bristles results in a less gentle use in the mouth of the user on the teeth and gums. To compensate for this disadvantage, the prior art suggests to construct the cleaning segments of these cleaning elements generally from a thermoplastic elastomer, in order to achieve a somewhat greater protection, especially of the gums.

It is an object of the present invention to provide a toothbrush of the type cited above, that offers good protection for the gums, that in addition to cleaning the tooth surfaces especially well also cleans the interdental space especially well, and is cost-effective to produce. This object is achieved by means of a toothbrush disclosed herein.

Further advantageous embodiments of the invention are described in the subclaims.

In a more advantageous design of the toothbrush, at least one indentation is provided in the area of the cleaning segment of the cleaning element so that the cleaning segment has an increased bending flexibility in this place. In so far as the material parameters remain constant over the length of the cleaning element, the indentation yields a greater bending flexibility compared to a segment without indentation, as long as the indentation does not counteract the bending flexibility. The indentation provides a geometric shape analogous to a set kink or bending point, which leads to a preferred deflection of the cleaning element at the indentation, wherein with such a preferred deflection this means an increased deflection compared to neighboring segments without indentations. Aside from this, the indentation allows a certain bend direction so that relative to the arrangement of the cleaning element in the toothbrush head and considering the user's preferred manner of use of the toothbrush, which gives an optimal bending flexibility of the upper end segment of the cleaning element. The indentation formed across the longitudinal axis of the toothbrush is preferred, so that an increased bending flexibility is provided by means of the indentation in approximately the direction of the longitudinal axis of the toothbrush. It has turned out that the indentation leads, on the one hand, to a gentler cleaning of the teeth by means of the cleaning element along the face of the tooth and on the gums and, on the other hand, provides better interdental cleaning, because the cleaning element, by means of the indentation in the cleaning segment, first of all bends more easily as it rubs along on the outer faces of the teeth and through the projection given by the tooth faces, presents a flexibility, and, on the other hand, upon reaching an interdental space, springs back into a generally lengthwise elongated neutral position due to the indentation, in particular the upper end section of the cleaning element, as if by spring action, so that a deep interdental cleaning is possible. The ability of the cleaning element to pivot around the attachment segment in the head region of the cleaning element known in the prior art has not yet led to this effect in the desired degree.

In an advantageous embodiment, several indentations are provided on the cleaning segment of the cleaning element, so that the cleaning segments with these indentations have an increased bending flexibility in two directions. The indentations are preferably arranged on opposite sides of the cleaning segment so that the two preferred bending directions lie in a plane. The plane of the bending directions is further preferred to be approximately parallel to the longitudinal axis of the toothbrush or to the longitudinal axis of the toothbrush head. The indentations have all of the indentation axes or bending axes around the indentations, which are essentially arranged perpendicular to the longitudinal axis of the toothbrush head. In this way, one is in line with the optimized ability of the cleaning segment to bend according to user behavior and the penetration into the interdental space is optimized.

In an advantageous embodiment, the cleaning segment has a wavelike region. Thus several indentations next to one another are provided on both sides of the cleaning elements, so that the bending flexibility is further increased.

It is advantageous to arrange at least one indentation, or the wavelike region of the indentations, between the upper end, the tip of the cleaning element, and the subsequent two-thirds of the length of the cleaning segment. In this way, the indentation or the wavelike region or all the indentations are arranged in the upper two-thirds along the length. It is preferable that at least one indentation is provided which is arranged in a segment between the upper end of the cleaning segment and half of the length of the longitudinal aspect of the cleaning segment. It turned out that by doing this, on the one hand, results in a good cleaning effect on the tooth flanks and, on the other hand, results in a good penetration into the interdental space.

In a further advantageous embodiment, at least one indentation or the wavelike region is arranged a tenth of the distance as seen from the upper end, in particular three-twentieths, or a fifth or, in additional embodiments, even further distant along the longitudinal aspect of the cleaning elements. The previous paragraph therefore defines a preferred maximal low point of the indentation as seen from the upper end of the cleaning element and this paragraph defines a preferred nearest location to the upper end of the cleaning segment.

In an advantageous embodiment of the invention, the cleaning segment has a narrow side and a broad side, wherein the indentation is formed and arranged in such a way that the bending flexibility along the broad side is increased. In this way, the specified bending ability resulting from the geometry of a wider broad side and a narrower narrow side increases the ability to bend due to the indentation, because this leads to an increase in the bending flexibility along the broad side, which in any case is more bendable. In an advantageous embodiment the ratio of the broad side to the narrow side is between 2:1 and 20:1. In this way, the cleaning element and, in particular, its cleaning segment in a footing region adjacent to the attachment segment, the broad side to narrow side ratio can be 2:1 to 5:1 and in the upper end region such a ratio can be from 4:1 to 20:1, so that the cleaning segment along the longitudinal aspect up to the upper end is tapered.

In an advantageous embodiment, the cleaning element is formed from just one plastic component. Both the cleaning segment and the attachment segment are formed from the same plastic component. This results in simplified production. This aspect can also constitute an additional invention, independent of other aspects or in combination with other aspects.

In an advantageous embodiment of the invention, the attachment segment and the head region of the toothbrush is formed in such a way that the cleaning element can only be detached from the head region by using a force of >8 Newton, in particular >12 Newton, and in particular >15 Newton. For example, the attachment segment is formed as a snap-action connection, so that the cleaning element is mounted in the head region of the toothbrush by snapping it on. In this way, this attachment segment or the snap-action connection is formed in such a way that by applying a traction force to the cleaning element of the toothbrush head, the cleaning element is detachable when a certain increasing force is applied, as stated above.

In an advantageous embodiment of the invention, the narrow side is straight and the broad side of the cleaning segment is provided with at least one, preferably with two or more indentations on both sides. Otherwise, no bending flexibility or only a slight bending flexibility is available along the narrow side and the bending flexibility on the broad side is increased even further due to the indentations.

In an advantageous embodiment of the invention, the cleaning element in the area of the indentations has a material width the same or smaller than the material width of the cleaning segment in the area of the attachment segment, particularly in the bending direction around the indentations.

In an advantageous embodiment of the invention, the cleaning segment of the attachment segment toward the upper end remains the same and/or reduces in width, particularly with respect to the width of the narrow side.

In an advantageous embodiment of the invention, each broad side of the cleaning segment in the wavelike region has alternating indentations and protrusions, wherein an indentation on a broad side forms a protrusion on the other side of the broad side lying opposite it and at the same height.

Further objectives, features, as well as advantageous possible uses of the present invention result from the following description of exemplary embodiments on the basis of the drawings. Here, all of the described and/or graphically represented features, considered alone or in any combination, form the subject matter of the present invention, independent of the claims or retroactive application thereof.

Figure 2:
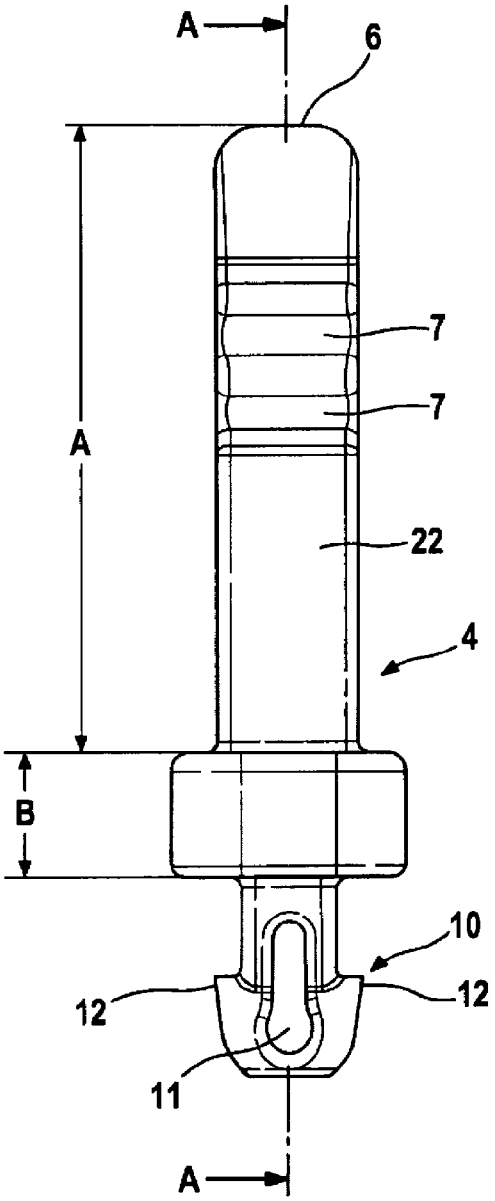
Figure 3:
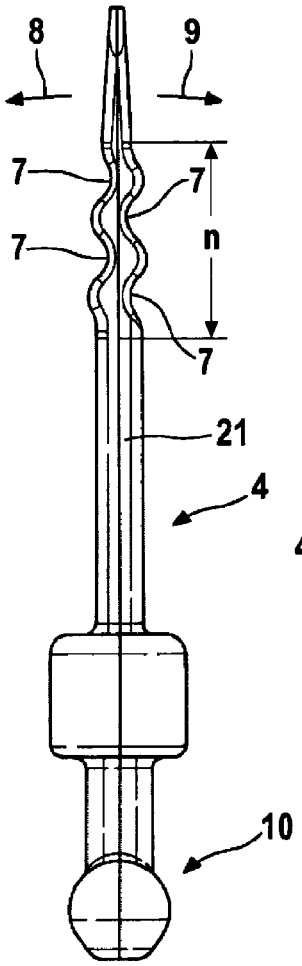
Figure 4:
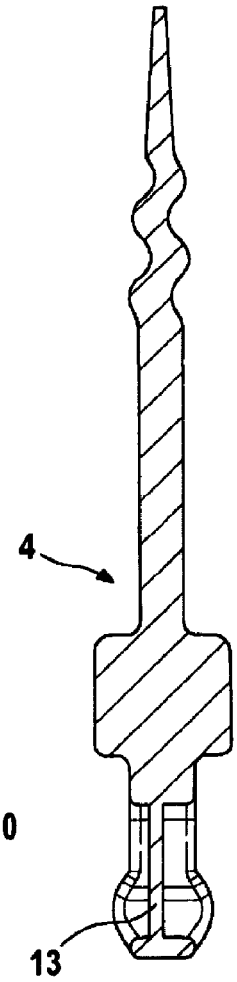
Figure 5:
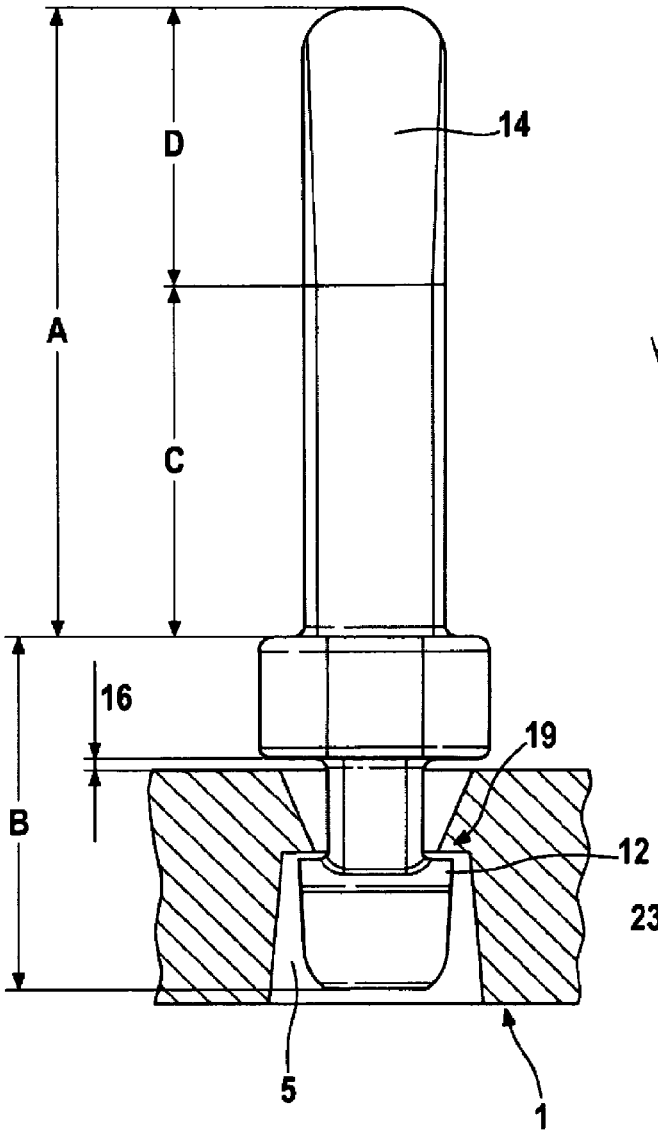
Figure 6:
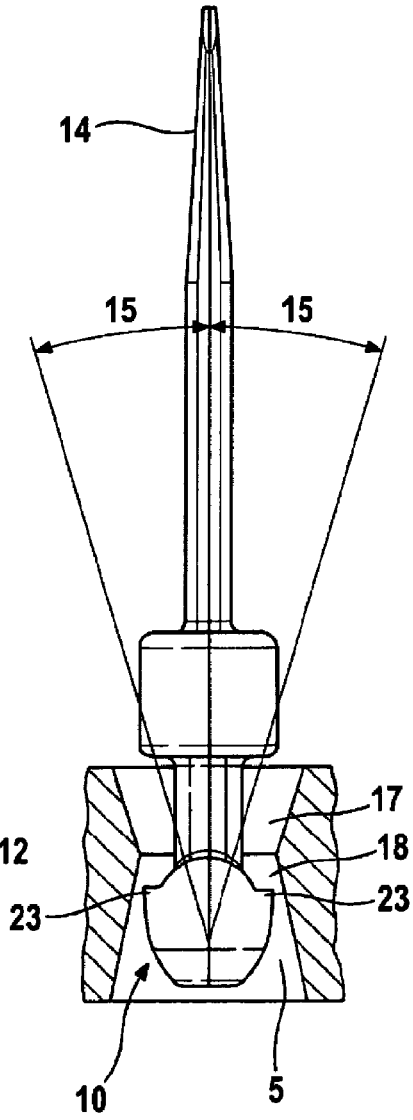
Figure 7:
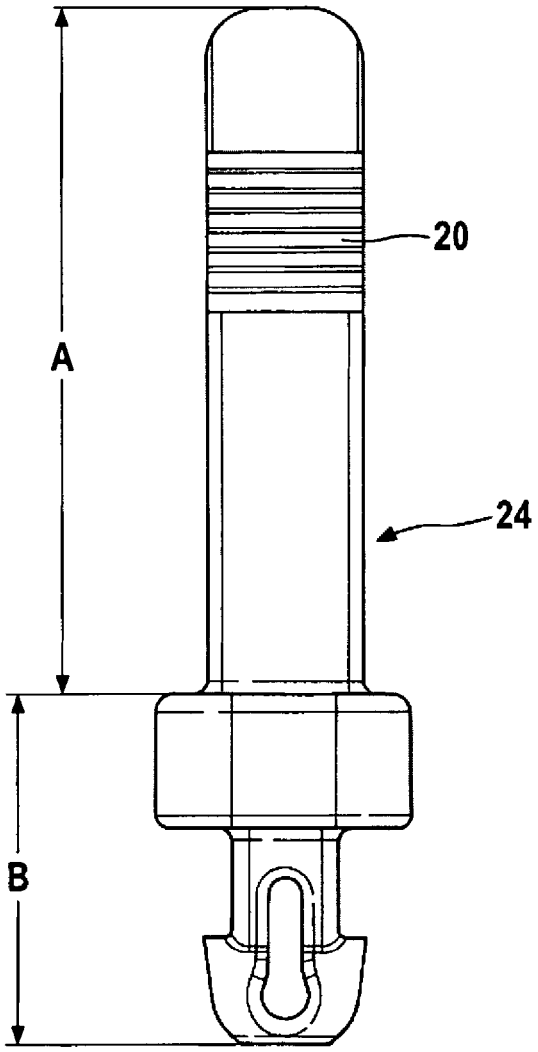
Figure 8:
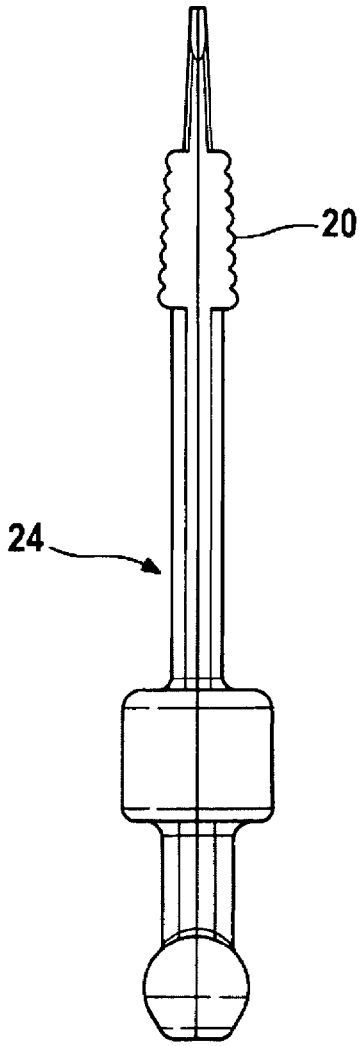

FIG. 1. shows a perspective view of a toothbrush with cleaning element according to the invention, FIG. 2. shows a front view of a first embodiment of the cleaning element according to FIG. 1, FIG. 3. shows a side view of the cleaning elements according to FIG. 2, FIG. 4. shows a longitudinal view along Line A-A in FIG. 2. of the first embodiment of the cleaning element, FIG. 5. shows a front view of a second embodiment of a cleaning element secured in a head region of a toothbrush, FIG. 6. shows a side view of the cleaning element according to FIG. 5, FIG. 7. shows a front view of a third embodiment of the cleaning element and, FIG. 8. shows a side view of the cleaning element according to FIG. 7.

FIG. 1 shows a perspective view of a toothbrush with a head region 1 and a neck region 2. The grip region is not shown in FIG. 1 and is joined to the neck region 2, in a manner known from the prior art. The cleaning elements 4, 14, and 24 are used principally in purely manual toothbrushes, in manual toothbrushes with electrically driven external units which make the tooth cleaning field vibrate, in attachable toothbrushes for electric toothbrushes and in all other tooth cleaning devices. The brush head 1 according to FIG. 1 has a tooth cleaning region which has bristle bundles 3 as well as several cleaning elements 4. In the present example, the bristle bundles 3 and the cleaning elements 4 are arranged along the longitudinal axis of the brush head, somewhat distant from one another, so that the present eight cleaning elements are arranged in the brush head. The cleaning elements 4 are attached in corresponding openings of the head region 1 by means of a snap-on or snap-action connection. Another attachment possibility, for example, with mechanical cold application or with application of heat as, for example, by means of heat sealing or hot stamping is likewise possible.

FIGS. 2 and 3 show a cleaning element from two different sides according to a first embodiment of the invention. The cleaning element is in an unmounted condition without the head region of the toothbrush being shown. The cleaning element preferably consists of a single plastic component, which, in particular, is a silicone material, a rubber mixture, an elastomer, a polypropylene or a thermoplastic elastomer (TPE). The cleaning element of TPE is preferably fashioned exclusively by injection molding. Additionally, a mixture of an elastomer with a hard plastic, for example PP, can also be considered as a source material. The preferred Shore A hardness, which applies to the entire cleaning element, lies between 75 SHA and 90 SHA or has a Shore D hardness of from 30 Shore D to 60 Shore D. The cleaning element 4 has a cleaning segment A and an attachment segment B. In the cross-section, the cleaning segment A is formed essentially as a rectangular fin. The cleaning segment has a narrow side 21. The cleaning segment A is additionally formed in such a way that it reduces in thickness from a lower end area adjacent to the attachment segment to an upper end 6. The reduction can begin only from the middle of the segment A, as shown here. The cleaning segment A has a wavelike area n which is provided with two indentations 7 on either side, which are capable of being longitudinally displaced relative each other. The indentations 7 extend across the entire width of the fin of the cleaning segment so that a force applied to the upper end 6 of the cleaning segment A produces an increased bending flexibility in the directions 8 and 9. Because the wavelike segment n is formed in the upper half of the cleaning segment A, only the upper end region of the cleaning segment A first bends according to the force applied during use on the upper end 6 and on the side flanks of the cleaning segment A. Alternatively, it is possible to have two indentations that are, for example, arranged at equal heights longitudinally. In another alternative embodiment, the increased bending flexibility in the area of the cleaning segment A is accomplished by means of indentations with different geometric shapes, in the form of recesses, notches, grooves, among other things, or with softer material segments opposite the materials of the cleaning segment A directly next to them. In an embodiment shown in FIGS. 2-4, the wavelike segment is formed from a first indentation 7 extending from a first broad side towards a second broad side and a second indentation 7 positioned either below or above the first indentation and extending from the second broad side towards the first broad side such that the first indentation extending from the first broad side has a corresponding bulge on the second broad side and the second indentation extending from the second broad side has a corresponding bulge on the first broad side. As is shown in FIGS. 3 and 4, a thickness (or caliper) of the cleaning element defined between the first broad side and the second broad side decreases through the wavelike region towards the upper end 6 of the cleaning segment. The cleaning element 4 also has an attachment segment B that is provided with a snap-on or snap-action device 10. By means of a recess 11 of the snap-on or snap-action device 10, during mounting in the openings 5 of the head area 1, the snap protrusion 12 can be easily displaced by pressing.

FIG. 4 shows a cross-sectional view of the cleaning element 4 along line A-A in FIG. 2. As shown in FIG. 4, an inner wall segment 13 is provided within the recess 11 of the snap-action connection; by means of its variations in the wall thickness, the extraction force with which the cleaning element 4 is detachable from the opening 5 can be adjusted. This extraction force (along the longitudinal axis of the cleaning element in the direction of the upper end 6) is preferably at least 10 N, 12 N or 15 N.

FIGS. 5 and 6 show front and side views of the cleaning elements in a snapped-in position of an opening 5 of the head region 1. The cleaning element 14 of FIGS. 5 and 6 corresponds largely to the cleaning element 4 according to the first embodiment, with the exception that, for example, no wavelike segment n is formed in the cleaning segment A. With respect to the cleaning segment A, it is readily apparent from FIGS. 5 and 6 that the cleaning segment A is provided with an approximately lower half C adjacent to attachment segment B with a uniform thickness, and an upper segment D which reduces in thickness toward the upper end 6. All embodiments of the cleaning elements represented have either a cleaning segment A which uniformly decreases toward the upper end 6 over the total length of the cleaning segment A, or which has a design according to a segment C and a segment D. As is shown in FIGS. 5 and 6, the opening 5 of the head region 1 has a segment 17 which initially narrows from top to bottom and an adjacent segment 18 which subsequently widens. After the snap catches 12 have surmounted the narrowest place 19 of the opening 5 when assembling, the cleaning element in the head region is fastened. The suggested embodiment of the attachment region B results in a loose attachment of the cleaning element in the opening with play, so that both a translatory motion in the axial direction of the cleaning element across the distance 16, amounting to a few millimeters, and also a pivoting movement around the pivoting angle 15 is possible. The pivoting angle 15 is preferably between ±10° and ±20°. As evident when comparing FIGS. 3 and 6, the snapping device in the side view can be provided as approximately cylindrical according to FIG. 3, or the snapping device can be provided with a second snap catch 23, for example, in a region rotated 90° to the snap catch 12 according to the side view according to FIG. 6. This increases the extraction force necessary to release the cleaning element from the openings. Additionally, the constriction 19 in FIG. 5 and the constriction in the second direction according to FIG. 6 result in a more difficult release of the cleaning element.

Because the suggested attachment options of the cleaning element for all embodiments according to FIGS. 2 through 8 are possible interchangeable, the basic ability of the cleaning element to pivot through the angle 15 leads to an initial withdrawal motion and leads to an additional flexibility of the cleaning region while it slides along the flanks of the teeth and presses into the interdental space by means of the indentation 7. The ability to pivot 15 and the ability to bend around the indentations 7 apply to the same side.

Preferably, the cleaning element according to the first embodiment according to FIGS. 2 through 4 in particular has an ability to bend (when the attachment region B is securely inserted and the bending force is exerted laterally on the upper end) from 30 mN to 60 mN (at 20° C.). When this lateral bending force is exerted in the middle of the cleaning segment A as well as on the broad side 22 and the other parameters remain the same, the present geometry requires a minimum bending force of from 140 mN to 200 mN, in particular of from 150 mN to 190 mN applied to the middle in order to bend the fin.

FIGS. 7 and 8 show a third embodiment of a cleaning element 24 in two different side views. The cleaning element 24 is different from the other two embodiments essentially in that no wavelike region n is formed in the cleaning region A, but a cleaning pad 20 is formed in the tapered region D, which extends approximately through the upper half of the cleaning segment A. The cleaning pad 20 can be formed in the same component as the cleaning element as a whole or in an even softer elastomer when compared to the other regions of the cleaning element.

In a further variation of the cleaning element 4, 14 and 24, the attachment segment B is formed from a hard plastic or from a mixture of a hard plastic and an elastomer. The cleaning segment A can likewise be made from the same plastic component as the segment B or can be formed from a softer material, in particular an elastomer.

What is claimed is:

1. A toothbrush comprising a cleaning element formed as a plastic injection molding part, that has an attachment segment for attachment in a head region of the toothbrush and a cleaning segment formed essentially as a rectangular fin, the cleaning segment having an upper end, a first broad side and an opposing second broad side, said first and second broad sides defining a thickness therebetween, and a wavelike region in the region of the cleaning segment, around which the cleaning segment has an increased bending flexibility, wherein the wavelike region is formed from a first indentation extending from the first broad side towards the second broad side and a second indentation positioned either below or above the first indentation and extending from the second broad side towards the first broad side, and wherein the first indentation extending from the first broad side has a corresponding bulge on the second broad side and the second indentation extending from the second broad side has a corresponding bulge on the first broad side, and wherein the thickness defined between the first and second broad sides decreases through the wavelike region towards the upper end of the cleaning segment.

2. The toothbrush according to claim 1, wherein the wavelike region is formed in such a way on the cleaning segment that the toothbrush has an increased bending flexibility in two directions.

3. The toothbrush according to claim 1, wherein at least one of the first indentation and the second indentation is arranged starting from the upper end of the cleaning segment facing away from the attachment segment between the upper end and the subsequent two-thirds of the extent of the length of the cleaning segment.

4. The toothbrush according to claim 1, wherein at least one of the first indentation and the second indentation is arranged, starting from the upper end of the cleaning segment, facing away from the attachment segment, from the upper end after a tenth, in particular after three-twentieths, of the length of the cleaning segment or further along the length, further away from the upper end.

5. The toothbrush according to claim 1, wherein the cleaning segment has a first and second narrow side and the first and second indentation are formed and arranged in such a way that the bending flexibility is increased along the first and second broad side.

6. The toothbrush according to claim 5, wherein the cleaning segment is formed in such a way that the ratio of a broad side to a narrow side is between at least 2:1 and up to 20:1 over the entire length of the cleaning segment.

7. The toothbrush according to claim 1, wherein the attachment segment and the head region of the toothbrush are formed in such a way that the cleaning element is detachable from the head region with only a force of from >8 N.

8. The toothbrush according to claim 1, wherein the cleaning segment has a narrow side width in the region of the indentations that is equal to or smaller than the narrow side width of the cleaning segment in the area of the attachment segment.

9. The toothbrush according to claim 1, wherein the thickness between the first broad side and the second broad side tapers toward the upper end of the cleaning segment.

* * * * *